US010920175B2

(12) United States Patent
Davis et al.

(10) Patent No.: US 10,920,175 B2
(45) Date of Patent: Feb. 16, 2021

(54) DISINFECTANT CLEANING COMPOSITION WITH QUATERNARY AMINE IONIC LIQUID

(71) Applicant: S.C. Johnson & Son, Inc., Racine, WI (US)

(72) Inventors: Gerald M. Davis, Racine, WI (US); Art Daniels Sutton, Jr., Mebane, NC (US); Michael Scott Haas, Franklin, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 4 days.

(21) Appl. No.: 16/341,743

(22) PCT Filed: Oct. 17, 2017

(86) PCT No.: PCT/US2017/056915
§ 371 (c)(1),
(2) Date: Apr. 12, 2019

(87) PCT Pub. No.: WO2018/080835
PCT Pub. Date: May 3, 2018

(65) Prior Publication Data

US 2020/0048581 A1 Feb. 13, 2020

Related U.S. Application Data

(60) Provisional application No. 62/413,243, filed on Oct. 26, 2016, provisional application No. 62/453,285, filed on Feb. 1, 2017.

(51) Int. Cl.

| | |
|---|---|
| ***C11D 1/835*** | (2006.01) |
| ***C11D 1/62*** | (2006.01) |
| ***C11D 1/72*** | (2006.01) |
| ***C11D 3/20*** | (2006.01) |
| ***C11D 11/00*** | (2006.01) |

(52) U.S. Cl.
CPC ..... *C11D 1/835* (2013.01); *C11D 1/62* (2013.01); *C11D 1/72* (2013.01); *C11D 3/2082* (2013.01); *C11D 11/0023* (2013.01)

(58) Field of Classification Search
CPC ..... C11D 1/835; C11D 1/62; C11D 1/722; C11D 3/33; C11D 3/48
See application file for complete search history.

(56) References Cited

U.S. PATENT DOCUMENTS

| | | | | |
|---|---|---|---|---|
| 4,284,435 | A | 8/1981 | Fox | |
| 4,551,506 | A | 11/1985 | Gosselink | |
| 5,061,395 | A * | 10/1991 | Meng | C11D 1/835 510/245 |
| 5,414,124 | A | 5/1995 | Smith et al. | |
| 5,441,541 | A | 8/1995 | Mehreteab et al. | |
| 5,472,455 | A | 12/1995 | Mehreteab et al. | |
| 5,552,089 | A | 9/1996 | Misselyn et al. | |
| 5,554,320 | A | 9/1996 | Yianakopoulos | |
| 5,798,329 | A | 8/1998 | Taylor et al. | |
| 5,827,451 | A | 10/1998 | Cummings et al. | |
| 5,939,059 | A | 8/1999 | Franklin et al. | |
| 5,962,388 | A | 10/1999 | Sherry et al. | |
| 5,994,602 | A | 11/1999 | Abdul-Sada et al. | |
| 6,462,014 | B1 | 10/2002 | Johnson et al. | |
| 6,465,403 | B1 | 10/2002 | Skee | |
| 6,509,012 | B1 | 1/2003 | Hossel et al. | |
| 6,544,350 | B2 | 4/2003 | Muller et al. | |
| 6,573,405 | B1 | 6/2003 | Abbott et al. | |
| 6,605,584 | B2 | 8/2003 | Fong et al. | |
| 6,693,070 | B1 * | 2/2004 | Cheung | A01N 33/12 510/235 |
| 6,878,681 | B1 | 4/2005 | Gohl et al. | |
| 6,953,773 | B2 | 10/2005 | Pereira et al. | |
| 7,183,433 | B2 | 2/2007 | Abbott et al. | |
| 7,186,675 | B2 | 3/2007 | Meine et al. | |
| 7,189,685 | B2 | 3/2007 | Hubig et al. | |
| 7,196,221 | B2 | 3/2007 | Abbott et al. | |
| 7,235,494 | B2 | 6/2007 | Andreas | |
| 7,348,303 | B2 | 3/2008 | Gallotti et al. | |
| 7,544,807 | B2 | 6/2009 | Wasserscheid et al. | |
| 7,588,645 | B2 | 9/2009 | Griese et al. | |
| 7,737,106 | B2 | 6/2010 | Kenneally et al. | |
| 7,776,810 | B2 | 8/2010 | Jordan, IV et al. | |
| 7,786,064 | B1 | 8/2010 | Hecht et al. | |
| 7,786,065 | B2 | 8/2010 | Hecht et al. | |
| 7,863,458 | B2 | 1/2011 | Wasserscheid et al. | |
| 7,880,024 | B2 | 2/2011 | Lim et al. | |
| 7,923,424 | B2 | 4/2011 | Small | |
| 7,928,053 | B2 | 4/2011 | Hecht et al. | |
| 8,110,537 | B2 | 2/2012 | Gohl et al. | |

(Continued)

FOREIGN PATENT DOCUMENTS

| | | |
|---|---|---|
| EP | 0 111 965 A2 | 6/1984 |
| GB | 2067196 B | 12/1983 |
| WO | WO 2018/080836 | 5/2018 |
| WO | WO 2018/080839 | 5/2018 |

OTHER PUBLICATIONS

CN103849490A Abstract, Jun. 11, 2014, 1 page.
CN104293489A Abstract, Jan. 21, 2015, 1 page.
Written Opinion for PCT Application No. PCT/2017/056915, dated Dec. 20, 2017, 8 pages.
U.S. Appl. No. 16/342,360, filed Apr. 16, 2019, Flugge-Berendes et al.
U.S. Appl. No. 16/342,737, filed Apr. 17, 2019, Sutton, Jr. et al.

*Primary Examiner* — Charles I Boyer

(57) ABSTRACT

An aqueous cleaning composition, which may be suitable for use in cleaning hard surfaces, is described. The aqueous cleaning composition includes an ionic liquid, a surfactant, a quaternary ammonium antimicrobial surfactant, and a substantial amount of water. The ionic liquid includes an N-alkyl-N,N-bis(polyethoxyethanol)-N-aliphatic ammonium salt. Other than an optional fragrance component, the cleaning composition typically is substantially free of volatile organic compounds. The cleaning compositions may also include a chelating agent, such as an aminopolycarboxylate chelating agent.

18 Claims, No Drawings

(56) References Cited

U.S. PATENT DOCUMENTS

| | | | | |
|---|---|---|---|---|
| 8,308,824 | B2 | 11/2012 | Wood et al. | |
| 8,481,474 | B1 | 7/2013 | Blattner et al. | |
| 8,518,298 | B2 | 8/2013 | Abbott | |
| 8,709,169 | B2 | 4/2014 | Company et al. | |
| 8,716,207 | B2 | 5/2014 | Blattner et al. | |
| 8,901,061 | B2 | 12/2014 | D'Ambrogio et al. | |
| 9,090,855 | B2 | 7/2015 | Polzin et al. | |
| 9,157,051 | B2 | 10/2015 | D'Ambrogio et al. | |
| 9,359,499 | B2 | 6/2016 | Cernohous | |
| 9,719,057 | B2 | 8/2017 | Nielsen et al. | |
| 9,920,284 | B2 | 3/2018 | Sutton, Jr. et al. | |
| 10,179,890 | B2 | 1/2019 | Sutton, Jr. et al. | |
| 2003/0064910 | A1 | 4/2003 | Fong et al. | |
| 2003/0073600 | A1* | 4/2003 | Avery | C11D 3/48 510/382 |
| 2003/0171247 | A1 | 9/2003 | Meine et al. | |
| 2003/0228991 | A1 | 12/2003 | Johnson et al. | |
| 2004/0077519 | A1 | 4/2004 | Price et al. | |
| 2004/0138084 | A1 | 7/2004 | Gohl et al. | |
| 2004/0266658 | A1 | 12/2004 | Lenhart | |
| 2005/0164903 | A1 | 7/2005 | Ko et al. | |
| 2006/0019863 | A1 | 1/2006 | Hubig et al. | |
| 2006/0084729 | A1 | 4/2006 | Clarke | |
| 2006/0157089 | A1 | 7/2006 | Taylor et al. | |
| 2006/0183654 | A1 | 8/2006 | Small | |
| 2006/0234889 | A1 | 10/2006 | Griese et al. | |
| 2006/0234890 | A1 | 10/2006 | Griese et al. | |
| 2007/0010607 | A1 | 1/2007 | Smith et al. | |
| 2008/0139443 | A1 | 6/2008 | Buzinski et al. | |
| 2009/0134526 | A1* | 5/2009 | Wang | H01L 23/5226 257/774 |
| 2010/0099314 | A1 | 4/2010 | Hecht et al. | |
| 2012/0225948 | A1* | 9/2012 | Heisig | A01N 33/12 514/642 |
| 2012/0258067 | A1 | 10/2012 | Yang et al. | |
| 2013/0247308 | A1 | 9/2013 | Duerrschmidt et al. | |
| 2013/0298948 | A1 | 11/2013 | Company et al. | |
| 2014/0065088 | A1 | 3/2014 | Frantz et al. | |
| 2014/0083465 | A1 | 3/2014 | D'Ambrogio et al. | |
| 2014/0090671 | A1 | 4/2014 | D'Ambrogio et al. | |
| 2014/0121291 | A1 | 5/2014 | Cernohous | |
| 2016/0017262 | A1 | 1/2016 | Monster et al. | |
| 2016/0151527 | A1 | 6/2016 | Holland et al. | |
| 2017/0073615 | A1 | 3/2017 | Company et al. | |

* cited by examiner

DISINFECTANT CLEANING COMPOSITION WITH QUATERNARY AMINE IONIC LIQUID

CROSS-REFERENCE TO RELATED APPLICATIONS

This patent application is a U.S. national stage of International Application Ser. No. PCT/US2017/056915, filed on Oct. 17, 2017, which claims the benefit of U.S. Provisional Application Ser. No. 62/413,243, filed on Oct. 26, 2016, and U.S. Provisional Application Ser. No. 62/453,285, filed on Feb. 1, 2017, the entire contents of which are hereby incorporated by reference, for any and all purposes.

BACKGROUND

Many current cleaning products often include using a "smelly" cleaner and compensate for the unpleasant odor by the need for running a fan, opening a window, or leaving the room; using a bad smelling cleaner but then following up with an air freshener or other solution; or using a cleaner that is not as effective and require more effort to clean. Current commercial cleaning products that perform well on the removal of soap scum or greasy soil often have an unpleasant odor. For instance, some cleaners are quite unpleasant to use and others may have a sour or bleach odor, which many consumers find objectionable.

SUMMARY

The present application relates generally to the field of cleaning compositions and, in particular, aqueous cleaning compositions which may be especially useful for cleaning hard surfaces. The present cleaning compositions include an ionic liquid and are desirably substantially free of solvent and other volatile organic compounds. In some instances, it may be desirable to include a small amount of fragrance material as the only volatile compound(s) in the cleaning composition. In ready to use form, the present cleaning compositions are typically aqueous compositions which include a substantial amount of water, e.g., at least about 75 wt. % and often at least about 85 wt. %, at least about 90 wt. %, or even 95 wt. % or higher amounts of water. The ionic liquid component may suitably include polyalkoxylated alkylammonium quaternary salt, such as an N-alkyl-N,N-bis(polyethoxyethanol)-N-aliphatic ammonium salt. For example, the ionic liquid may include N-alkyl-N,N-bis (polyethoxyethanol)-N-fatty ammonium alkylsulfate and/or N-alkyl-N,N-bis(polyethoxyethanol)-N-fatty ammonium halide. The cleaning compositions may also include a quaternary ammonium antimicrobial surfactant, such as a quaternary benzyl ammonium salt and/or a quaternary bis(n-alkyl)dimethylammonium salt. Quite commonly, the cleaning compositions may also include a nonionic surfactant, such as an ethoxylated alcohol. Optionally, the cleaning compositions may also include one or more adjuvants, such as a fragrance, a preservative, a complexing agent and/or a bleaching agent. Where such a cleaning composition is intended to be used as an aerosol cleaner, it may be formulated in a pressurized container together with a propellant, such as a hydrocarbon propellant, a hydrofluoroalkane propellant and/or a volatile ether propellant. The pH of the present cleaning compositions may vary over a range from slightly acidic to quite basic. Typically, the cleaning compositions may have a relatively neutral pH, e.g., a pH of at least about 6, up to a pH of about 12. Quite commonly, the pH of the cleaning compositions may be about 10 to 11.5.

DETAILED DESCRIPTION

The present cleaning compositions include an ionic liquid and, other than an optional fragrance component, are generally substantially free of solvent and other volatile organic compounds. For example, the cleaning composition may be substantially free of glycol ether solvents, aliphatic alcohol solvents, polyol solvents, and amino alcohol solvents. The present cleaning compositions are commonly environmentally friendly due to being based on a low volatile organic content (VOC) formulation. Even though having significantly lower amounts of solvents as compared to conventional hard surface cleaning compositions, no loss of performance as to cleaning is generally observed (rather improved cleaning is typically obtained). As referred to herein, a composition having a low VOC or composition substantially free of volatile organic compounds is considered to be one which, other than an optional fragrance component, the composition contains no more than 0.1 wt. % volatile organic compounds. In some embodiments, a present cleaning compositions may have an even lower VOC concentration such as ≤0.05 wt. % or ≤0.01 wt. % VOC.

In one aspect, the present cleaning compositions include (a) an ionic liquid, (b) a nonionic surfactant; (c) quaternary ammonium antimicrobial surfactant; and (d) at least about 75 wt. % water; wherein the ionic liquid includes N-alkyl-N,N-bis(polyethoxyethanol)-N-aliphatic ammonium salt; and other than an optional fragrance component the composition is substantially free of volatile organic compounds.

In some embodiments, the compositions may have a pH of no more than about 12. In some embodiments, the compositions may have a pH of about 6 to 12 and, more typically, about 7 to 11.5. In some embodiments, the compositions have a pH of about 10 to 11.5. Commonly, the pH of the compositions is chosen so as to maintain a desired level antimicrobial activity (i.e., disinfectant) of the quaternary ammonium antimicrobial surfactant.

In some embodiments, the present cleaning compositions include one or more ionic liquids including a N-alkyl-N,N-bis(polyethoxyethanol)-N-aliphatic ammonium salt. The N-alkyl-N,N-bis(polyethoxyethanol)-N-aliphatic ammonium salt may include an N-alkyl group that includes 1 to 5 carbon atoms; an N-aliphatic group that may include 10 to 22 carbon atoms; and a counter anion that may include halides, alkyl sulfonates, or alkyl sulfates. Exemplary anions include chloride, ethosulfate, and methosulfate. In some embodiments, the N-alkyl-N,N-bis(polyethoxyethanol)-N-aliphatic ammonium salt may include N—$C_{1-2}$-alkyl-N,N-bis(polyethoxyethanol)-N—$C_{10-22}$ aliphatic ammonium salt. In some instances, the N—$C_{1-2}$-alkyl-N,N-bis(polyethoxyethanol)-N—$C_{10-22}$ aliphatic ammonium salt may include an N—$C_{1-2}$-alkyl-N,N-bis(polyethoxyethanol)-N—$C_{10-18}$ fatty ammonium salt. Nonlimiting examples include N—$C_{1-2}$-alkyl-N,N-bis(polyethoxyethanol)-N-tallow ammonium salt and/or N—$C_{1-2}$-alkyl-N,N-bis(polyethoxyethanol)-N-coco ammonium salt. In some embodiments, the ionic liquid may include N-ethyl-N,N-bis(polyethoxyethanol)-N-tallow ammonium ethosulfate) ("E-BPE-TA-ES").

In some embodiments, the N—$C_{1-2}$-alkyl-N,N-bis(polyethoxyethanol)-N—$C_{10-18}$ fatty ammonium salt may include: N-ethyl-N,N-bis(polyethoxyethanol)-N-myristryl ammonium chloride; N-ethyl-N,N-bis(polyethoxyethanol)-N-myristryl ammonium ethosulfate; N-methyl-N,N-bis (polyethoxyethanol)-N-myristryl ammonium chloride; N-methyl-N,N-bis(polyethoxyethanol)-N-myristryl ammonium methosulfate; N-ethyl-N,N-bis(polyethoxyethanol)-N-palmityl ammonium chloride; N-ethyl-N,N-bis(polyethoxyethanol)-N-palmityl ammonium ethosulfate; N-methyl-N,N-bis(polyethoxyethanol)-N-palmityl ammonium chloride; N-methyl-N,N-bis(polyethoxyethanol)-N-palmityl ammonium methosulfate; N-ethyl-N,N-bis(polyethoxyethanol)-N-stearyl ammonium chloride; N-ethyl-N,N-bis(polyethoxyethanol)-N-stearyl ammonium ethosulfate; N-methyl-N,N-bis(polyethoxyethanol)-N-stearyl ammonium chloride; N-methyl-N,N-bis(polyethoxyethanol)-N-stearyl ammonium methosulfate; N-ethyl-N,N-bis(polyethoxyethanol)-N-oleyl ammonium chloride; N-ethyl-N,N-bis(polyethoxyethanol)-N-oleyl ammonium ethosulfate; N-methyl-N,N-bis(polyethoxyethanol)-N-oleyl ammonium chloride; N-methyl-N,N-bis(polyethoxyethanol)-N-oleyl ammonium methosulfate; or a combination of any two or more thereof.

In some embodiments, the N—$C_{1-2}$-alkyl-N,N-bis(polyethoxyethanol)-N—$C_{10-18}$ fatty ammonium salt may include an N—$C_{1-2}$-alkyl-N,N-bis(polyethoxyethanol)-N-coco ammonium salt. The N—$C_{1-2}$-alkyl-N,N-bis(polyethoxyethanol)-N-coco ammonium salt may include: N-ethyl-N,N-bis(polyethoxyethanol)-N-capryl ammonium chloride; N-ethyl-N,N-bis(polyethoxyethanol)-N-capryl ammonium ethosulfate; N-methyl-N,N-bis(polyethoxyethanol)-N-capryl ammonium chloride; N-methyl-N,N-bis(polyethoxyethanol)-N-capryl ammonium methosulfate; N-ethyl-N,N-bis(polyethoxyethanol)-N-lauryl ammonium chloride; N-ethyl-N,N-bis(polyethoxyethanol)-N-lauryl ammonium ethosulfate; N-methyl-N,N-bis(polyethoxyethanol)-N-lauryl ammonium chloride; N-methyl-N,N-bis(polyethoxyethanol)-N-lauryl ammonium methosulfate; N-ethyl-N,N-bis(polyethoxyethanol)-N-myristryl ammonium chloride; N-ethyl-N,N-bis(polyethoxyethanol)-N-myristryl ammonium ethosulfate; N-methyl-N,N-ethyl-N,N-bis(polyethoxyethanol)-N-myristryl ammonium chloride; N-methyl-N,N-ethyl-N,N-bis(polyethoxyethanol)-N-myristryl ammonium methosulfate; N-ethyl-N,N-bis(polyethoxyethanol)-N-palmityl ammonium chloride; N-ethyl-N,N-bis(polyethoxyethanol)-N-palmityl ammonium ethosulfate; N-methyl-N,N-bis(polyethoxyethanol)-N-palmityl ammonium chloride; N-methyl-N,N-bis(polyethoxyethanol)-N-palmityl ammonium methosulfate; or a combination of any two or more thereof.

Nonlimiting examples of the ionic liquid include VARIQUAT® T 1210 NS—a methyl bis-(polyethoxyethanol) tallow ammonium chloride quaternary surfactant; REWOQUAT® CPEM—a coco pentaethoxy methyl ammonium methosulfate; ethoxylated cocoalkyl bis-(hydroxyethyl)methyl ammonium methylsulfate; VARIQUAT® K 1215—a methyl bis-(polyethoxy ethanol) coco ammonium chloride; and Adogen® 66, Berol® 563 SA, or loLiLyte $T_2$EG—an ethyl bis-(polyethoxyethanol) tallow ammonium ethosulfate ("E-BPE-TA-ES"). The one or more ionic liquids may be present in the compositions from about 0.05 wt % to about 5 wt %. In some embodiments, the composition may include about 0.1 wt % to about 2 wt % of the ionic liquid. In some embodiments, the composition may include about 0.3 wt % to about 0.7 wt % of the ionic liquid.

Other examples of suitable N-alkyl-N,N-bis(polyethoxyethanol)-N-aliphatic ammonium salts for use in the present cleaning compositions include bis-(polyethoxyethanol) quaternary ammonium compounds, such as stearyl methyl bis (ethoxy) ammonium chloride (12 moles EO), stearyl ethyl bis(ethoxy) ammonium ethosulfate (15 moles EO), C18 alkyl methyl bis(ethoxy) ammonium methosulfate (15 moles EO), C18 alkyl bis(ethoxy) methyl ammonium methyl sulfate (25 moles EO), tallow methyl bis(ethoxy) ammonium methosulfate (15 moles EO), tallow ethyl bis(ethoxy) ammonium ethosulfate (15 moles EO), hydrogenated tallow methyl bis(ethoxy) ammonium chloride (15 moles EO), C14 alkyl bis(ethoxy) methyl ammonium methyl sulfate (15 moles EO) and/or coco methyl bis(ethoxy) ammonium methosulfate (20 moles EO). Particularly suitable bis (ethoxylated) quaternary ammonium compounds include tallow methyl bis(ethoxy) ammonium methyl sulfate (15 moles EO) and the tallow ethyl bis(ethoxy) ammonium ethyl sulfate (15 moles EO). In the above description the amount of ethoxylation shown in parentheses is the average total ethoxylation for the molecule, e.g., tallow methyl bis (ethoxy) ammonium methyl sulfate (15 moles EO) contains an average of 15 moles of ethylene oxide. The values for individual x and y may vary, however, the combined total affects the HLB of these compounds. Typically, the bis (ethoxylated) quaternary ammonium compounds useful in the present cleaning compositions have an average total ethoxylation of about 10 moles EO to 30 moles EO and may have an HLB of from about 14.0 to 22.0.

The compositions may include one or more nonionic surfactants. The nonionic surfactant may be an alkoxylated alcohol, such as an ethoxylated alcohol (e.g., ethoxylated ($C_8$-$C_{16}$) alcohol). In some embodiments, the ethoxylated alcohol may be an ethoxylated ($C_{10}$-$C_{15}$) linear or branched aliphatic alcohol. The ethoxylated alcohol may have an average of about 5-15, typically 5-12 ethylene oxide groups. Nonlimiting examples include ethoxylated long chain $C_{10}$-Guerbet alcohols, such as those produced by BASF and sold under the trade names LUTENSOL® XL100, LUTENSOL® XL80, LUTENSOL® XL70, LUTENSOL® XL60 and LUTENSOL® XP80 and. Particularly suitable nonionic surfactants include ethoxylated $C_{10}$-Guerbet alcohols having an HLB of from about 10 to about 15, commonly from about 12 to about 15. Examples include LUTENSOL XL80—an ethoxylated $C_{10}$-Guerbet alcohol with an average of 8 ethylene oxide (EO) groups, LUTENSOL® XL100—an ethoxylated $C_{10}$-Guerbet alcohol with an average of 10 EO groups, and an ethoxylated $C_{10}$-Guerbet alcohol having an HLB of about 13, such as the surfactant produced by BASF Corp. and sold under the trade name LUTENSOL® XL70.

Other examples of suitable nonionic surfactants include ethoxylated linear alcohols, such as ethoxylated linear alcohols having a $C_{10}$-$C_{15}$ n-alkyl group. Nonlimiting examples include LUTENSOL® TDA 10 (produced by BASF)—an ethoxylated tridecyl alcohol having an average of 10 EO groups, Tomadol® 91-6—a $C_9$-$C_{11}$ ethoxylated alcohol having an average of 6 EO groups, SURFONIC® L12-8—a $C_{10}$-$C_{12}$ ethoxylated alcohol having an average of 8 EO groups, and LUTENSOL® AO-8—a synthetic $C_{13}$-$C_{15}$ ethoxylated oxo alcohol having an average of 8 EO groups.

Particularly suitable nonionic surfactants for use in the present cleaning compositions include ethoxylated fatty alcohols, e.g., ethoxylated $C_{12}$/$C_{14}$ fatty alcohols having a degree of ethoxylation of about 5 to 12 (5-12 EO) and more suitably a degree of ethoxylation of about 6 to 10; ethoxylated oxo alcohols, e.g., ethoxylated $C_{11}$-$C_{13}$ oxo alcohols having a degree of ethoxylation of about 5 to 15 and more suitably a degree of ethoxylation of about 5 to 10; ethoxylated Guebert alcohols, e.g., ethoxylated $C_{10}$ Guebert alcohols having a degree of ethoxylation of about 5 to 15 and more suitably a degree of ethoxylation of about 5 to 12; and ethoxylated secondary alcohols, e.g., secondary ethoxylated $C_8$-$C_{16}$ alcohols or ethoxylated $C_{8-16}$-n-alkanol having a degree of ethoxylation of about 5 to 15 and more suitably a degree of ethoxylation of about 5 to 10 including ethoxylated $C_{11}$-$C_{15}$ secondary alcohols. Non-limiting example includes TERGITOL™ 15-S-7—a mixture of ethoxylated $C_{11}$-$C_{15}$ secondary alcohols having an average of 7 EO groups, Genapol® LA 070S—an ethoxylated lauryl alcohol having an average of 7 EO groups, and Genapol® LA 070—an ethoxylated C12/C14 fatty alcohol having an average of 7 EO groups.

Additional suitable nonionic surfactants include alkyl amine oxides, such as linear alkyl amine oxides. Typical alkyl amine oxides include water-soluble amine oxides of the formula $R^1$—$N(R^2)(R^3)O$ where $R^1$ is typically a $C_8$-$C_{18}$ alkyl moiety and the $R^2$ and $R^3$ moieties are typically selected from the group consisting of hydrogen, $C_1$-$C_3$ alkyl groups and $C_1$-$C_3$ hydroxyalkyl groups. Quite often, the alkyl amine oxide is a linear alkyl amine oxide where $R^1$ is a $C_8$-$C_{18}$ n-alkyl and $R^2$ and $R^3$ are methyl, ethyl, propyl, isopropyl, 2-hydroxethyl, 2-hydroxypropyl and/or 3-hydroxypropyl. The linear amine oxide surfactants in particular may include linear $C_8$-$C_{14}$ alkyl dimethyl amine oxides and linear $C_8$-$C_{12}$-alkoxyethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide). In some embodiments, the nonionic surfactant may include an N—$C_{10-14}$-fatty alkyldimethylamine oxide (e.g., N-lauryl dimethylamine oxide, N-myristyl dimethylamine oxide and/or N-capryl dimethylamine oxide).

In some embodiments, the composition may include about 0.05 wt % to about 5 wt % of the nonionic surfactant and, more commonly, about 0.1 wt % to about 3 wt % of the nonionic surfactant.

The cleaning composition may contain an anionic surfactant component. Anionic surfactants are often desirably included in cleaning compositions because of their wetting and detersive properties. Suitable examples of anionic surfactants include anionic sulfonate and/or sulfate surfactants. For example, the anionic surfactant component may include alkyl sulfate, alkyl ether sulfate, alkyl sulfonate and/or alkyl ether sulfonate surfactants. Suitable alkyl sulfates include those typically having an $C_8$-$C_{18}$ alkyl group. In some instances the alkyl sulfates suitably contain a secondary alkyl group. Examples of suitable alkyl sulfates include, but are not limited to, sodium octyl sulfate, sodium decyl sulfate, sodium lauryl sulfate, sodium lauryl/myristyl sulfate and mixtures thereof. Suitable alkane sulfonates that can be used in the cleaning composition may desirably have an alkane group having 8 to 22 carbon atoms. The alkyl sulfonates may include a secondary alkane sulfonate and/or alpha olefin sulfonate. The secondary alkane sulfonate may suitably include sodium $C_{14}$-$C_{17}$ secondary alkyl sulfonate (commercially available as Hostapur SAS from Clariant). Suitable alpha olefin sulfonates include those having alpha olefin groups containing 10 to 18 carbon atoms. Suitable alkyl ether sulfates may have about 1 to 10 repeating alkoxy groups, e.g., about 1 to 5 repeating ethoxy groups. In general, the alkoxy group will typically include between about 2 and about 4 carbon atoms and, commonly is an ethoxy group. One example of a suitable alkyl ether sulfate is sodium lauryl ether sulfate (sodium laureth sulfate). In some embodiments, the anionic surfactant may include a sodium octyl sulfate. When the cleaning compositions include an anionic surfactant component, the composition typically includes about 0.1 to 5 wt. % and, more commonly, about 0.5 to 3 wt. % of the anionic surfactant.

When the present cleaning composition includes an anionic surfactant component, quite commonly the composition includes an alkyl sulfate salt and/or alkyl sulfonate salt. For example, the cleaning composition may include a sodium $C_{8-12}$-alkyl sulfate, such as sodium lauryl and/or sulfate sodium octyl sulfate. In other embodiments, the cleaning composition may include an ethoxylated fatty alcohol sulfate and/or sulfonate ester, such as sodium laureth sulfate, as an anionic surfactant.

As discussed above, the present cleaning compositions typically include an antimicrobial quaternary ammonium surfactant, such as a quaternary benzyl ammonium salt and/or a quaternary dialkyl ammonium salt. For example, the present cleaning compositions may include an N-(n-$C_{12-16}$)-alkyl-N-benzyl dimethylammonium chloride, an N-(n-$C_{12-16}$)-alkyl-N-ethylbenzyl dimethylammonium chloride, a bis(n-$C_{8-12}$-alkyl)dimethylammonium chloride, or a combination of any two or more thereof. When the cleaning compositions include an antimicrobial quaternary ammonium surfactant, it is typically present as about 0.05 to 1 wt. % and, more commonly, about 0.1 to 0.5 wt. % of the composition. As used herein, "antimicrobial" refers to a composition able to kill or slow the spread of microorganisms such as bacteria, virus, protozoans, and/or fungi.

In some embodiments, the antimicrobial quaternary ammonium surfactant may include a quaternary benzyl ammonium surfactant. The quaternary benzyl ammonium surfactant may include an N-alkyl-N,N-dimethyl (opt. substituted)benzyl ammonium salt. In some embodiments, the antimicrobial quaternary ammonium surfactant may include N—$C_{10-18}$-alkyl-N,N-dimethyl benzyl ammonium halide and/or N—$C_{10-18}$-alkyl-N,N-dimethyl ethylbenzyl ammonium halide. In another embodiment, the antimicrobial quaternary ammonium surfactant may include N—$C_{12-14}$-alkyl-N,N-dimethyl benzyl ammonium chloride and/or N—$C_{12-14}$-alkyl-N,N-dimethyl ethylbenzyl ammonium chloride. In some embodiments, the antimicrobial quaternary ammonium surfactant may include N-n-$C_{12-14}$-alkyl-N,N-dimethyl benzyl ammonium chloride and/or N-n-$C_{12-14}$-alkyl-N,N-dimethyl ethylbenzyl ammonium chloride.

In some embodiments, the antimicrobial quaternary ammonium surfactant may include a quaternary dialkyl ammonium surfactant. Examples of suitable quaternary dialkyl ammonium surfactants include N,N-di-$C_{8-18}$-alkyl-N,N-dimethyl ammonium halides, such as bis(n-$C_{8-12}$-alkyl)dimethylammonium chlorides. In some embodiments, the antimicrobial quaternary ammonium surfactant may include N,N-dioctyl-N,N-dimethyl ammonium chloride, N,N-didecyl-N,N-dimethyl ammonium chloride and N-octyl-N-decyl-N,N-dimethyl ammonium chloride.

Examples of the antimicrobial quaternary ammonium surfactants include, but are not limited to, BTC® 885 (available from Stepan Company), BTC® 888 (available from Stepan Company), BTC® 2125M (available from Stepan Company), Bardac 2280 (available from Lonza), Barquat MB-80 (available from Lonza), Bardac 2250 (available from Lonza), and Carboquat H (available from Lonza). BTC® 885 is a quaternary ammonium antimicrobial surfactant which is a mixture of n-alkyl (50% C14, 40% C12, 10% C16) dimethyl benzyl ammonium chloride (20%), n-octyl, n-decyl dimethyl ammonium chloride (15), di-n-octyl dimethyl ammonium chloride (7.5%), and di-n-decyl dimethyl ammonium chloride (7.5%). BTC® 888 is a mixture of n-alkyl (50% C14, 40% C12, 10% C16) dimethyl benzyl ammonium chloride (32%), n-octyl, n-decyl dimethyl ammonium chloride (24%), di-n-octyl dimethyl ammonium chloride (12%), and di-n-decyl dimethyl ammonium chloride (12%). BTC® 2125M is a mixture of n-alkyl (60% C14, 30% C16, 5% C12, 5% C18) dimethyl benzyl ammonium chloride and n-alkyl (68% C12, 32% C14) dimethyl ethylbenzyl ammonium chloride. Bardac 2280 is N,N-Didecyl-N,N-dimethylammoniumchloride. Barquat MB-80 is a mixture of n-alkyl (50% C14, 40% C12, 10% C16) dimethyl benzyl ammonium chloride salts. Bardac 2250 is di-n-decyl dimethyl ammonium chloride. Carboquat H is a mixture di-n-decyl dimethyl ammonium carbonate and bicarbonate salts.

In some aspects, the cleaning composition may also include a chelating agent. The chelating agent may be a polycarboxylate. Suitable chelating agents include aminopolycarboxylate chelating agents, such iminodisuccinate salt (IDSA), ethylenediaminetetraacetate (EDTA) salt, hydroxyethylethylenediaminetriacetate (HEEDTA) salt, 2-hydroxyethyliminodiacetate (HEIDA) salt, nitrilotriacetate (NTA) salt, glutamate diacetic acid salt (GLDA), methylglutamate diacetic acid salt (MGDA), diethylenetriaminepentaacetic acid salt, (DETAPA), triethylenetetraminehexaacetic acid salt (TETAHA), 1,3-diamino-2-hydroxypropane-N,N,N',N'-tetraacetic acid salt, 1,2-diaminocyclohexane-N,N,N',N'-tetraacetic acid salt, [S,S]-ethylenediaminedisuccinic acid (EDDS) salt, or a combination of any two or more thereof. In some instances, the cleaning composition may also include an alkali metal of the aminopolycarboxylate chelating agent, typically a sodium or potassium salt of the chelating agent. For example, cleaning composition may also include an alkali metal of iminodisuccinic acid, e.g., tetrasodium iminodisuccinate (IDSA), and/or an alkali metal sodium salt glutamate diacetic acid, e.g., the tetrasodium salt glutamate diacetic acid (GLDA). Commonly, where an aminopolycarboxylate chelating agent is present in cleaning composition, the composition includes a sodium salt of iminodisuccinic acid and/or a sodium salt of glutamate diacetic acid. In some embodiments, the chelating agent may include a hydroxycarboxylic acid, such as citric. In some embodiments, the chelating agent may include a hydroxycarboxylic acid and an aminopolycarboxylate.

In another aspect, the present cleaning compositions may include (a) an ionic liquid, (b) a nonionic surfactant; (c) quaternary ammonium antimicrobial surfactant; and (d) at least about 75 wt. % water; wherein the composition has a pH of no more than about 12. In some embodiments, the composition, other than an optional fragrance component, is substantially free of glycol ether solvents, aliphatic alcohol solvents, polyol solvents and amino alcohol solvents.

In another aspect, the present cleaning compositions may include (a) an ionic liquid, which includes N-alkyl-N,N-bis (polyethoxyethanol)-N-aliphatic ammonium salt; (b) a nonionic surfactant and/or anionic surfactant; (c) quaternary ammonium antimicrobial surfactant; and (d) at least about 75 wt. % water; wherein, other than an optional fragrance component, the composition is substantially free of volatile organic compounds. In some embodiments, the anionic surfactant may include an alkyl sulfate and/or alkyl sulfonate anionic surfactant. In some embodiments, the nonionic surfactant may include an alkyl dimethyl amine oxide.

The present technology also contemplates an aqueous cleaning composition that includes (a) an ionic liquid, which comprises N-alkyl-N,N-bis(polyethoxyethanol)-N-aliphatic ammonium salt; (b) a nonionic surfactant and/or anionic surfactant; (c) quaternary ammonium antimicrobial surfactant; and (d) at least about 75 wt. % water; wherein the composition has a pH of no more than about 12. In some embodiments, the composition, other than an optional fragrance component, is substantially free of glycol ether solvents, aliphatic alcohol solvents, polyol solvents and amino alcohol solvents. In some embodiments, the composition may have a pH of at least about 6, up to a pH of about 12 (e.g., the pH of the cleaning compositions may be about 10 to 11.5); other than an optional fragrance component, the composition is substantially free of volatile organic compounds; and the nonionic surfactant includes an ethoxylated $C_{8-16}$-aliphatic alcohol having an average degree of ethoxylation of about 5 to 12.

In another aspect, the present cleaning compositions may include (a) about 0.05 to 3 wt. % N—$C_{1-2}$-alkyl-N,N-bis (polyethoxyethanol)-N-tallow ammonium salt; (b) about 0.1 to 0.5 wt. % N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)dimethylammonium chloride; (c) about 0.2 to 3 wt. % ethoxylated $C_{10-15}$-alkanol having an average degree of ethoxylation of about 5 to 10; (d) about 0.5 to 5 wt. % iminodisuccinate salt and/or glutamate diacetic acid salt; and (e) at least about 90 wt. % water; wherein the composition may have a pH of at least about 6, up to a pH of about 12 (e.g., the pH of the cleaning compositions may be about 10 to 11.5) and, other than an optional fragrance component, the composition is substantially free of volatile organic compounds. In some embodiments, the composition may further include an additional antimicrobial quaternary ammonium surfactant. In some embodiments, the composition may further include a fragrance component. The fragrance component may be present from about 0.05 to 0.3 wt. % of the composition.

The present cleaning compositions may also include additional components or agents, such as additional functional materials (which may also be referred to as "adjuvants"). In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present cleaning preparations containing the ionic liquids may optionally contain other soil-digesting components, surfactants, disinfectants, detergent fillers, sanitizers, acidulants, complexing agents, biocides, corrosion inhibitors, anti-redeposition agents, foam inhibitors, dyes, bleaching agents, enzymes, enzyme stabilizing systems, thickening or gelling agents, wetting agents, dispersants, stabilizing agents, and/or fragrances.

For example, the aqueous cleaning compositions may also include various adjuvants as is conventional for hard surface cleaners. Examples of such adjuvants include one or more of a fragrance, preservative, dyes, corrosion inhibitors, antioxidants and the like. Adjuvants are generally present in an amount less than 0.5 wt. % and commonly are present in an amount of about 100 ppm to about 0.2 wt. % of the composition. Quite commonly, the present the aqueous cleaning compositions may include a fragrance component and/or a preservative.

In another aspect, the present technology provides a method for cleaning a hard surface that includes applying any of the cleaning composition disclosed herein to a hard surface; wherein the hard surface includes a first concentration of soap scum. The method further comprising removing the composition from the hard surface; wherein the hard surface includes a second concentration of soap scum and the second concentration of soap scum may be at least about 50% less than the first concentration of soap scum. In some embodiments, the second concentration of soap scum may be at least about 60%, at least about 70%, or at least about 80% less than the first concentration of soap scum. Typically, the removal of the composition from the hard surface is conducted by scrubbing by hand. In some embodiments, the removal of the composition from the hard surface is conducted by rinsing with water that is not highly pressurized (e.g., sink or shower facet water).

As used herein, "fragrance" refers to any perfume, odor-eliminator, odor masking agent, the like, and combinations thereof. In some embodiments, a fragrance is any substance which may have an effect on a consumer, or user's, olfactory senses. In some embodiments, other than an optional fragrance component, the composition may be substantially free of glycol ether solvents, aliphatic alcohol solvents, polyol solvents, and amino alcohol solvents.

As used herein, "wt. %" refers to the weight percentage of an ingredient in the total formula. For example, an off-the-shelf commercial composition of Formula X may only contain 70% active ingredient X. Thus, 10 g of the off-the-shelf composition only contains 7 g of X. If 10 g of the off-the-shelf composition is added to 90 g of other ingredients, the wt. % of X in the final formula is thus only 7%.

As used herein, "substantially free of" volatile organic compounds refers to no more than 0.1 wt. % volatile organic compounds. In some embodiments, the level of volatile organic compounds may be even lower, e.g., ≤0.05 wt. % or ≤0.01 wt. % volatile organic compounds.

EXAMPLES

The following examples more specifically illustrate protocols for preparing aqueous cleaning compositions according to various embodiments described above. These examples should in no way be construed as limiting the scope of the present technology.

Example 1

Tables 1 and 2 below show the composition of a number of exemplary formulations of the present aqueous cleaning compositions. These formulations include an ionic liquid component, a quaternary ammonium antimicrobial surfactant, nonionic surfactant, and water. The results of the Soap Scum Test demonstrate the relative effectiveness of these formulations.

TABLE 1

| Raw Material | Formula A | Formula B | Formula C |
|---|---|---|---|
| Water wt % | 93-96.4 | 93-95.4 | 93-94.4 |
| E-BPE-TA-ES Ionic liquid wt % | 0.5 | 0.5 | 0.5 |
| Nonionic surfactant wt % | 1.0[3] | 1.0[3] | 0.75[4] |
| Quat. ammonium antimicrobial surfactant wt % | 0.3[1] | 0.3[1] | 0.3[2] |
| Citric acid wt % | — | 1.0 | — |
| Aminopolycarboxylate chelating agent wt % | 1.7[5] | 1.7[5] | 4[6] |
| Preservative wt % | 0.01 | 0.01 | 0.01 |
| Fragrance wt % | 0.15 | 0.15 | 0.1 |
| pH | 6-8 | 6-8 | 6-8 |
| Soap Scum (ASTM D5343) | 92.9 +/− 3.9% | | 62.7 +/− 4.5% |
| Soap Scum (CSPA DCC-16) | 97.2 +/− 1.5% | | |

[1]Bardac 2280 (didecyldimethyl ammonium chloride);
[2]BTC 888 (alkyl benzyl ammonium chloride and alkyl ammonium chlorides blend);
[3]ethoxylated C12 alcohol;
[4]ethoxylated $C_{11}$-$C_{15}$ secondary alcohol;
[5]IDSA;
[6]GLDA.

TABLE 2

| Raw Material | Formula D | Formula E | Formula F |
|---|---|---|---|
| Water wt % | 89.2 | 85.6 | 89.1 |
| E-BPE-TA-ES Ionic liquid wt % | 0.5 | 0.5 | 0.5 |
| Nonionic surfactant wt % | 0.75[4] | 0.75[4] | 0.75[4] |
| Quat. ammonium antimicrobial surfactant wt % | — | 0.32[2] | 0.32[2] |
| Citric acid wt % | 0.42 | — | — |
| Aminopolycarboxylate chelating agent wt % | 9.2[6] | 12.7[5] | 9.2[6] |
| Preservative wt % | — | — | — |
| Fragrance wt % | 0.11 | 0.11 | 0.11 |

[1]Bardac 2280 (didecyldimethyl ammonium chloride);
[2]BTC 888 (alkyl benzyl ammonium chloride and alkyl ammonium chlorides blend);
[3]ethoxylated C12 alcohol;
[4]ethoxylated $C_{11}$-$C_{15}$ secondary alcohol;
[5]IDSA;
[6]GLDA.

Soap Scum (ASTM D5343) Test.

The following test was used to evaluate the cleaning capability of various cleaning compositions to remove soap scum from a hard surface (Soap Scum Test—"SS"). The following is a brief description of the "soap scum" removal test.

SOIL AND TEST PLATE PREPARATION:

1. SOAP SCUM SOIL IS PREPARED USING PRECIPITATED FATTY ACID SALTS.
2. TEST PLATES (TILE) ARE PRECLEANED, DRIED, AND WEIGHED PRIOR TO SOILING. THE PRESOILING WEIGHT OF EACH PLATE IS RECORDED.
3. THE SOAP SCUM SOIL IS APPLIED TO TEST PLATES IN A MANNER TO ENSURE CONSISTENCY REGARDING THE AMOUNT AND AREA OF SOIL APPLIED.
4. SOILED PLATES ARE THEN BAKED TO CURE THE SOIL. PLATES ARE COOLED TO ROOM TEMPERATURE PRIOR TO CLEANING TESTS.

CLEANING:

1. A SOILED PLATE IS SPRAYED (TRIGGER OR AEROSOL DISPENSER) WITH AN AMOUNT OF A TEST CLEANING FORMULA AND THEN THE PLATE IS PLACED ON A GARDNER SCRUBBING DEVICE.
2. A SPONGE OR OTHER CLEANING IMPLEMENT IS DAMPENED WITH WATER AND INSERTED INTO THE SCRUBBER'S SLED.
3. THE SLED IS POSITIONED ON THE TEST PLATE AND THE SCRUBBING DEVICE IS ACTIVATED.
4. AFTER A PREDETERMINED NUMBER OF CYCLES HAVE BEEN COMPLETED, THE SCRUBBING DEVICE IS STOPPED AND THE PLATE IS REMOVED.
5. THE CLEANED PLATE IS RINSED UNDER RUNNING WATER AND SET ASIDE TO AIR DRY.
6. THE CLEANING PROCEDURE IS REPEATED AS NEEDED FOR ADDITIONAL PLATES.

ASSESSMENT:

1. PLATES ARE WEIGHED AND STATISTICALLY ASSESSED TO DETERMINE THE AVERAGE PERCENT OF SOIL REMOVED ALONG WITH THE STANDARD DEVIATION (SD).
2. FORMULA TO FORMULA COMPARISONS CAN THEN BE MADE.

Illustrative Embodiments

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

In one aspect, the aqueous cleaning composition may include (a) an ionic liquid, (b) a nonionic surfactant; (c) quaternary ammonium antimicrobial surfactant; and (d) at least about 75 wt. % water; wherein the ionic liquid comprises N-alkyl-N,N-bis(polyethoxyethanol)-N-aliphatic ammonium salt; and other than an optional fragrance material the composition is substantially free of volatile organic compounds {e.g., ≤0.1 wt. % VOC}. Such aqueous cleaning compositions commonly have a pH of no more than about 12.

In such compositions the ionic liquid may include an N—$C_{1-2}$-alkyl-N,N-bis(polyethoxyethanol)-N—$C_{10-22}$ aliphatic ammonium salt. The N—$C_{1-2}$-alkyl-N,N-bis(polyethoxyethanol)-N—$C_{10-22}$ aliphatic ammonium salt may include an N—$C_{1-2}$-alkyl-N,N-bis(polyethoxyethanol)-N—$C_{10-18}$ fatty ammonium salt. The an N—$C_{1-2}$-alkyl-N,N-bis(polyethoxyethanol)-N—$C_{10-18}$ fatty ammonium salt may include an N—$C_{1-2}$-alkyl-N,N-bis(polyethoxyethanol)-N-tallow ammonium salt. In some embodiments, the an N—$C_{1-2}$-alkyl-N,N-bis(polyethoxyethanol)-N—$C_{10-18}$ fatty ammonium salt may include N-ethyl-N,N-bis(polyethoxyethanol)-N-myristryl ammonium chloride; N-ethyl-N,N-bis(polyethoxyethanol)-N-myristryl ammonium ethosulfate; N-methyl-N,N-bis(polyethoxyethanol)-N-myristryl ammonium chloride; N-methyl-N,N-bis(polyethoxyethanol)-N-myristryl ammonium methosulfate; N-ethyl-N,N-bis(polyethoxyethanol)-N-palmityl ammonium chloride; N-ethyl-N,N-bis(polyethoxyethanol)-N-palmityl ammonium ethosulfate; N-methyl-N,N-bis(polyethoxyethanol)-N-palmityl ammonium chloride; N-methyl-N,N-bis(polyethoxyethanol)-N-palmityl ammonium methosulfate; N-ethyl-N,N-bis(polyethoxyethanol)-N-stearyl ammonium chloride; N-ethyl-N,N-bis(polyethoxyethanol)-N-stearyl ammonium ethosulfate; N-methyl-N,N-bis(polyethoxyethanol)-N-stearyl ammonium chloride; N-methyl-N,N-bis(polyethoxyethanol)-N-stearyl ammonium methosulfate; N-ethyl-N,N-bis(polyethoxyethanol)-N-oleyl ammonium chloride; N-ethyl-N,N-bis(polyethoxyethanol)-N-oleyl ammonium ethosulfate; N-methyl-N,N-bis(polyethoxyethanol)-N-oleyl ammonium chloride; N-methyl-N,N-bis(polyethoxyethanol)-N-oleyl ammonium methosulfate; or a combination of any two or more thereof.

The quaternary ammonium antimicrobial surfactant may include an N-alkyl-N-benzyl dimethylammonium halide, N-alkyl-N-alkylbenzyl dimethylammonium halide, N,N-dialkyl-dimethylammonium halide, or a combination of any two or more thereof. For example, the quaternary ammonium antimicrobial surfactant may include N-(n-$C_{12-16}$)-alkyl-N-benzyl dimethylammonium chloride, N-(n-$C_{12-16}$)-alkyl-N-ethylbenzyl dimethylammonium chloride, N,N-bis(n-$C_{8-12}$-alkyl)-dimethylammonium chloride, or a combination of any two or more thereof.

The nonionic surfactant may include nonionic surfactant comprises ethoxylated $C_{8-16}$-aliphatic alcohol having an average degree of ethoxylation of about 5 to 12 (e.g., secondary ethoxylated $C_{8-16}$-aliphatic and/or ethoxylated $C_{8-16}$-n-alkanol). In some embodiments, the nonionic surfactant may include an N—$C_{10-14}$-fatty alkyldimethylamine oxide. In some embodiments, the aqueous cleaning compositions may optionally include one or more of a preservative, fragrance material, and anionic surfactant.

The aqueous cleaning composition may also include a polycarboxylate chelating agent, such as a hydroxycarboxylic acid (e.g., lactic acid and/or citric acid) or an aminopolycarboxylate chelating agent. Suitable examples of aminopolycarboxylate chelating agents include an iminodisuccinate salt (IDSA), ethylenediaminetetraacetate (EDTA) salt, hydroxyethylethylenediaminetriacetate (HEEDTA) salt, 2-hydroxyethyliminodiacetate (HEIDA) salt, nitrilotriacetate (NTA) salt, glutamate diacetic acid salt (GLDA), methylglutamate diacetic acid salt (MGDA), diethylenetriaminepentaacetic acid salt, (DETAPA), triethylenetetraminehexaacetic acid salt (TETAHA), 1,3-diamino-2-hydroxypropane-N,N,N',N'-tetraacetic acid salt, 1,2-diaminocyclohexane-N,N,N',N'-tetraacetic acid salt, [S,S]-ethylenediaminedisuccinic acid (EDDS) salt, or a combination of any two or more thereof.

In many instances, the aqueous cleaning composition described above may include the following weight percent of the various components.

| Raw Material | Wt % |
|---|---|
| Water | 75-97 |
| Ionic liquid | 0.1-5 |
| Nonionic surfactant | 0.1-5 |
| Quat. ammonium antimicrobial surfactant | 0.1-0.5 |
| Hydroxycarboxylic acid chelating agent | 0-1 |
| Aminopolycarboxylate chelating agent | 0-10 |
| Preservative | 0-0.1 |
| Fragrance | 0-0.3 |
| pH | 10-12 |

In another aspect, the aqueous cleaning composition may (a) an ionic liquid, (b) a nonionic surfactant; (c) quaternary ammonium antimicrobial surfactant; and (d) at least about 75 wt. % water; wherein the composition has a pH of no more than about 12. In some embodiments, other than an optional fragrance component, the composition is substantially free of glycol ether solvents, aliphatic alcohol solvents, polyol solvents and amino alcohol solvents.

In a further aspect, the aqueous cleaning composition may include (a) an ionic liquid, which comprises N-alkyl-N,N-bis(polyethoxyethanol)-N-aliphatic ammonium salt; (b) a nonionic surfactant and/or anionic surfactant; (c) quaternary ammonium antimicrobial surfactant; and (d) at least about 75 wt. % water; wherein other than an optional fragrance component, the composition is substantially free of volatile organic compounds. The anionic surfactant may include an alkyl sulfate and/or alkyl sulfonate anionic surfactant. The nonionic surfactant may include an ethoxylated alcohol and/or an alkyl dimethylamine oxide.

In another aspect, the aqueous cleaning composition may include (a) an ionic liquid, which comprises N-alkyl-N,N-bis(polyethoxyethanol)-N-aliphatic ammonium salt; (b) a nonionic surfactant and/or anionic surfactant; (c) quaternary ammonium antimicrobial surfactant; and (d) at least about 75 wt. % water; wherein the composition has a pH of no more than about 12. In some embodiments, other than an optional fragrance component, the composition is substantially free of glycol ether solvents, aliphatic alcohol solvents, polyol solvents and amino alcohol solvents. The composition may have a pH of at least about 6, up to a pH of about 12 (e.g., the pH of the cleaning compositions may be about 10 to 11.5); other than an optional fragrance component the composition may be substantially free of volatile organic compounds; and the nonionic surfactant may include ethoxylated $C_{8-16}$-aliphatic alcohol having an average degree of ethoxylation of about 5 to 12.

In another aspect, the aqueous cleaning composition may include (a) about 0.05 to 3 wt. % N—$C_{1-2}$-alkyl-N,N-bis (polyethoxyethanol)-N-fatty ammonium halide and/or alkyl sulfate salt; (b) about 0.1 to 0.5 wt. % quaternary ammonium antimicrobial surfactant; (c) about 0.2 to 3 wt. % ethoxylated $C_{10-15}$-alkanol; (d) about 0.5 to 5 wt. % aminopolycarboxylate chelating agent; and (e) at least about 90 wt. % water; where the composition has a pH of at least about 6, up to a pH of about 12 (e.g., the pH of the cleaning compositions may be about 10 to 11.5). Desirably, other than an optional fragrance component, such compositions may be substantially free of glycol ether solvents, aliphatic alcohol solvents, polyol solvents and amino alcohol solvents. In some embodiments, other than an optional fragrance component the composition is substantially free of volatile organic compounds. In some embodiments, the composition may also include a fragrance material.

In another aspect, the aqueous cleaning composition may include (a) about 0.05 to 3 wt. % N—$C_{1-2}$-alkyl-N,N-bis (polyethoxyethanol)-N-tallow ammonium salt; (b) about 0.1 to 0.5 wt. % N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)dimethylammonium chloride; (c) about 0.2 to 3 wt. % ethoxylated $C_{10-15}$-alkanol having an average degree of ethoxylation of about 5 to 10; (d) about 0.5 to 5 wt. % iminodisuccinate salt and/or glutamate diacetic acid salt; and (e) at least about 90 wt. % water; wherein the composition has a pH of at least about 6, up to a pH of about 12 (e.g., the pH of the cleaning compositions may be about 10 to 11.5) and other than an optional fragrance component the composition is substantially free of volatile organic compounds. In some embodiments, the composition may also include a fragrance material.

In another aspect, the present technology provides a method for cleaning a hard surface that includes applying the composition of any of compositions provided above to a hard surface; wherein the hard surface comprises a first concentration of soap scum. The method may further include removing the composition from the hard surface; wherein the hard surface comprises a second concentration of soap scum and the second concentration of soap scum is least 50% less than the first concentration of soap scum.

In another aspect, a method for cleaning a hard surface having a first concentration of soap scum thereon is provided. The method includes applying the present cleaning composition to the hard surface and then removing the composition from the hard surface (e.g., via rubbing with a rag, sponge or mop), such that after removal the hard surface has a second concentration of soap scum, which is no more than about 50% of the first concentration of soap scum.

While certain embodiments have been illustrated and described, it should be understood that changes and modifications can be made therein in accordance with ordinary skill in the art without departing from the technology in its broader aspects.

The embodiments, illustratively described herein may suitably be practiced in the absence of any element or elements, limitation or limitations, not specifically disclosed herein. Thus, for example, the terms "comprising," "including," "containing," shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof.

What is claimed is:

1. An aqueous cleaning composition comprising:

(a) about 0.1 to 3 wt. % of an ionic liquid, (b) about 0.5 to 5 wt. % of a nonionic surfactant comprising an ethoxylated $C_{8-16}$-aliphatic alcohol surfactant having an average degree of ethoxylation of about 5 to 12;

(c) about 0.1 to 1 wt. % quaternary ammonium antimicrobial surfactant;

(d) aminopolycarboxylate chelating agent; and (e) at least about 85 wt. % water;

wherein the ionic liquid comprises an N—$C_{1-2}$-alkyl-N, N-bis(polyethoxyethanol)-N—$C_{16-18}$-aliphatic ammonium salt;

the composition has a pH of about 6 to 8; and other than an optional fragrance component, the composition is substantially free of glycol ether solvents, aliphatic alcohol solvents, polyol solvents and amino alcohol solvents.

2. The composition of claim 1, wherein the aminopolycarboxylate chelating agent comprises a sodium salt of iminodisuccinic acid (IDSA) and/or a sodium salt of glutamate diacetic acid (GLDA).

3. The composition of claim 1, further comprising citric acid.

4. The composition of claim 1, wherein the ionic liquid comprises N-methyl-N,N-bis(polyethoxyethanol)-N-tallow ammonium chloride, N-ethyl-N,N-bis(polyethoxyethanol)-N-tallow ammonium ethosulfate, and/or N-methyl-N,N-bis(polyethoxyethanol)-N-tallow ammonium methosulfate.

5. The composition of claim 1, wherein the quaternary ammonium antimicrobial surfactant comprises N-(n-$C_{12-16}$)-alkyl-N-benzyl dimethylammonium chloride, N-(n-$C_{12-16}$)-alkyl-N-ethylbenzyl dimethylammonium chloride, N,N-bis(n-$C_{8-12}$-alkyl)-dimethylammonium chloride, or a combination of any two or more thereof.

6. The composition of claim 1, wherein the composition comprises (a) about 0.1 to 5 wt. % of the ionic liquid, (b) about 0.2 to 5 wt. % of the nonionic surfactant; (c) about 0.1 to 0.5 wt. % of the quaternary ammonium antimicrobial surfactant.

7. The composition of claim 6, wherein the composition comprises about 0.5 to 10 wt. % of the aminopolycarboxylate chelating agent.

8. The composition of claim 1, wherein the other than an optional fragrance material the composition contains no more than about 0.1 wt. % volatile organic compounds.

9. The composition of claim 1, wherein the composition comprises:

(a) about 0.05 to 3 wt. % N—$C_{1-2}$-alkyl-N,N-bis(polyethoxyethanol)-N-tallow ammonium salt;

(b) about 0.1 to 0.5 wt. % N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)-dimethylammonium chloride;

(c) about 0.2 to 3 wt. % of the ethoxylated $C_{8-16}$-aliphatic alcohol having an average degree of ethoxylation of about 5 to 12;

(d) about 0.5 to 5 wt. % iminodisuccinate salt and/or glutamate diacetic acid salt; and (e) at least about 90 wt. % water.

10. The composition of claim 1, wherein the composition comprises:

(a) about 0.1 to 5 wt. % of the N—$C_{1-2}$-alkyl-N,N-bis(polyethoxyethanol)-N—$C_{10-18}$-fatty alkyl ammonium alkylsulfate salt;

(b) about 0.1 to 0.5 wt. % quaternary benzyl ammonium surfactant;

(c) about 0.2 to 5 wt. % of the ethoxylated $C_{8-16}$-aliphatic alcohol surfactant;

(d) about 0.5 to 10 wt. % iminodisuccinate salt and/or glutamate diacetate salt; and (e) at least about 85 wt. % water; and wherein the total amount of glycol ether solvents, aliphatic alcohol solvents, polyol solvents and amino alcohol solvents in the composition is no more than about 0.01 wt. %.

11. The composition of claim 1, wherein the composition comprises:

(a) about 0.05 to 5 wt. % N-methyl-N,N-bis(polyethoxyethanol)-N-tallow ammonium salt and/or N-ethyl-N,N-bis(polyethoxyethanol)-N-tallow ammonium salt;

(b) about 0.1 to 0.5 wt. % N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)-dimethylammonium chloride;

(c) about 0.2 to 3 wt. % ethoxylated $C_{8-16}$-alcohol having an average degree of ethoxylation of about 5 to 10;

(d) about 0.5 to 10 wt. % iminodisuccinate salt and/or glutamate diacetic acid salt; and (e) at least about 85 wt. % water.

12. The composition of claim 1, wherein N-alkyl-N,N-bis(polyethoxyethanol)-N-aliphatic ammonium salt comprises:

N-ethyl-N,N-bis(polyethoxyethanol)-N-palmityl ammonium ethosulfate;

N-ethyl-N,N-bis(polyethoxyethanol)-N-stearyl ammonium ethosulfate;

N-ethyl-N,N-bis(polyethoxyethanol)-N-oleyl ammonium ethosulfate; or a combination of any two or more thereof.

13. A method for cleaning a hard surface having a first concentration of soap scum thereon, the method comprising applying the composition of claim 1 to the hard surface; and removing the composition from the hard surface, such that after removal the hard surface has a second concentration of soap scum, which is no more than about 50% of the first concentration of soap scum.

14. An aqueous cleaning composition comprising:

(a) about 0.1 to 3 wt. % of an ionic liquid comprising N—$C_{1-2}$-alkyl-N,N-bis(polyethoxyethanol)-N—$C_{16}$ aliphatic ammonium salt and/or N—$C_{1-2}$-alkyl-N,N-bis(polyethoxyethanol)-N—$C_{18}$ aliphatic ammonium salt;

(b) about 0.1 to 5 wt. % nonionic surfactant, which comprises ethoxylated $C_{10-15}$-aliphatic alcohol having an average degree of ethoxylation of about 5 to 12;

(c) about 0.1 to 1 wt. % quaternary ammonium antimicrobial surfactant; and (d) about 0.5 to 10 wt. % iminodisuccinate salt and/or glutamate diacetic acid salt; and (e) at least about 85 wt. % water;

wherein the composition has a pH of about 6 to 8; and other than an optional fragrance component, the composition contains no more than 0.1 wt. % total of glycol ether solvents, aliphatic alcohol solvents, polyol solvents and amino alcohol solvents.

15. The composition of claim 14, further comprising citric acid.

16. The composition of claim 14, wherein the quaternary ammonium antimicrobial surfactant comprises N-(n-$C_{12-16}$)-alkyl-N-benzyl dimethylammonium chloride, N-(n-$C_{12-16}$)-alkyl-N-ethylbenzyl dimethylammonium chloride and/or bis(n-$C_{8-12}$-alkyl)-dimethylammonium chloride, or a combination of any two or more thereof.

17. The composition of claim 14, wherein the composition comprises about 0.5 to 5 wt. % of the iminodisuccinate salt; and other than the optional fragrance component, the composition contains no more than about 0.1 wt. % volatile organic compounds;

the ionic liquid comprises N-ethyl-N,N-bis(polyethoxyethanol)-N-tallow ammonium ethosulfate, and/or N-methyl-N,N-bis(polyethoxyethanol)-N-tallow ammonium methosulfate;

the ethoxylated $C_{10-15}$-aliphatic alcohol comprises ethoxylated lauryl alcohol; and the quaternary ammonium antimicrobial surfactant comprises N,N-didecyl-N,N-dimethyl ammonium chloride.

18. The composition of claim 17, further comprising citric acid.

* * * * *